US010610432B1

(12) United States Patent
Justice

(10) Patent No.: US 10,610,432 B1
(45) Date of Patent: Apr. 7, 2020

(54) COLLAPSIBLE LIFTING DEVICE AND METHOD

(71) Applicant: Bryan M. Justice, Friendsville, TN (US)

(72) Inventor: Bryan M. Justice, Friendsville, TN (US)

( * ) Notice: Subject to any disclaimer, the term of this patent is extended or adjusted under 35 U.S.C. 154(b) by 145 days.

(21) Appl. No.: 15/898,334

(22) Filed: Feb. 16, 2018

(51) Int. Cl.
*A61G 7/10* (2006.01)

(52) U.S. Cl.
CPC ..... *A61G 7/1074* (2013.01); *A61G 7/1015* (2013.01)

(58) Field of Classification Search
CPC .. A61G 7/1074; A61G 7/1015; A61G 7/1038; B66C 19/02
USPC ..... 5/81.1 R–81.1; 248/163.2, 43
See application file for complete search history.

(56) References Cited

U.S. PATENT DOCUMENTS 1,148,068 A * 7/1915 Allen ..... B66C 19/02 104/126
1,214,104 A 1/1917 Wingire
1,543,686 A * 6/1925 Wengraf ..... B66C 19/02 52/40
1,962,042 A * 6/1934 Stevenson ..... A61G 7/1015 254/327
2,343,014 A * 2/1944 Langan ..... B66C 19/02 212/324
2,516,553 A 7/1950 Cole
3,222,029 A * 12/1965 Hildemann ..... A61G 7/1017 254/8 R
3,520,514 A * 7/1970 Evans ..... B66C 19/02 248/163.2
3,765,630 A 10/1973 Wooley
4,117,561 A 10/1978 Zamotin
4,296,509 A 10/1981 Simmons
4,860,404 A 8/1989 Flachs
5,165,123 A 8/1992 Colpron
D378,457 S * 3/1997 Page ..... D34/28
5,694,654 A 12/1997 Roy
6,637,610 B1 10/2003 Cheeseboro
7,806,755 B1 * 10/2010 Martinelli ..... A22B 5/06 452/185
8,286,281 B1 * 10/2012 Toothman ..... A61G 7/1015 248/166
9,675,829 B1 * 6/2017 Katz ..... A63B 1/00
9,814,644 B2 11/2017 Clark
9,918,437 B2 * 3/2018 Spencer ..... A01G 23/062
10,207,142 B2 * 2/2019 Le Nguyen ..... A63B 21/4035
2007/0246974 A1 10/2007 Bjork

* cited by examiner

*Primary Examiner* — Joshua T Kennedy

(57) ABSTRACT

A collapsible lifting device including a top support member, multiple braced legs extending downward, and a hoist assembly. The legs may be hingedly, pivotally, and/or slidably connected to the other legs and/or to braces and/or to the top support member. The device is easily transportable and storable. The device may be used by a single typical caregiver to lift a person or other load from a lower position to a higher position or from a higher position to a lower position, such as lifting a person from the floor to a seated position. The device is movable from a collapsed position, defined as the feet of the legs being together, to an open position, defined as the feet of the legs extended apart with braces positionally fixed.

2 Claims, 14 Drawing Sheets

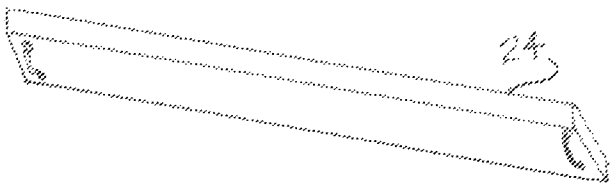
FIG. 8
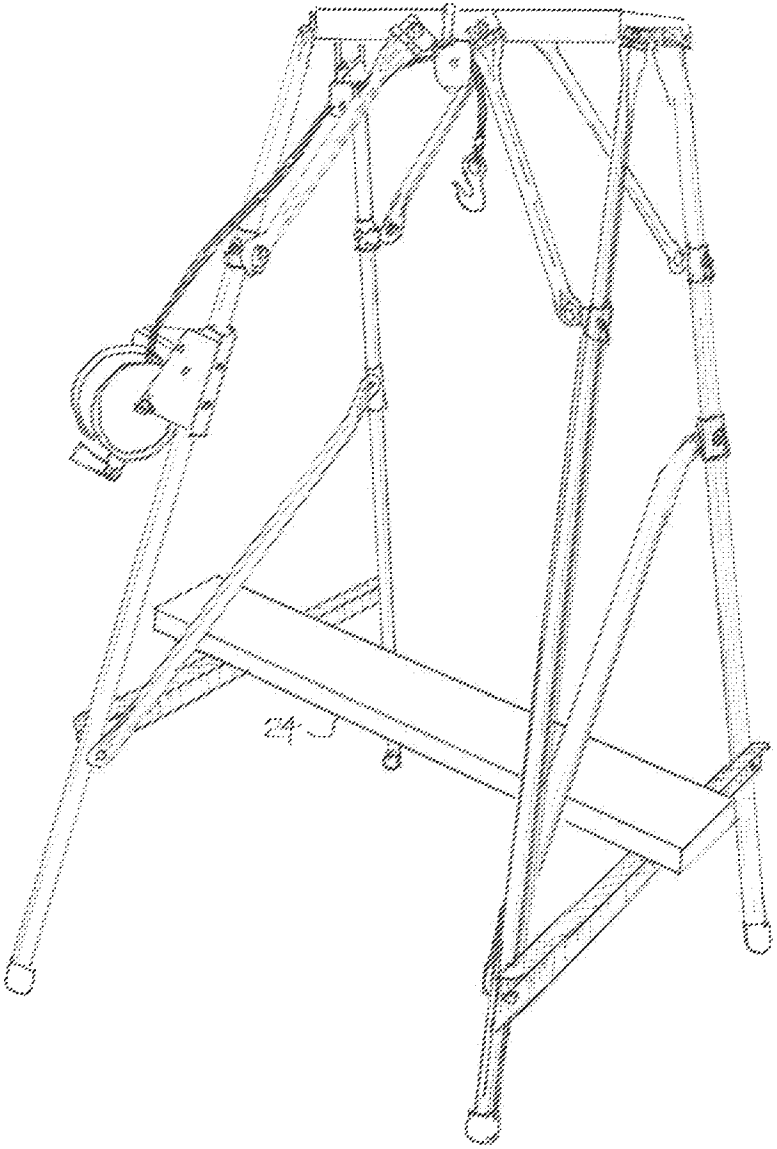

COLLAPSIBLE LIFTING DEVICE AND METHOD

CROSS-REFERENCE TO RELATED APPLICATIONS

Not applicable

FEDERALLY SPONSORED RESEARCH

Not applicable

SEQUENCE LISTING OR PROGRAM

Not applicable

FIELD OF THE INVENTION

The embodiments of the lifting device relate to the field of hoisting systems; more specifically, to lifting persons.

BACKGROUND OF THE INVENTION

Many individuals suffer from various conditions which make it difficult or impossible for them to rise from the floor or ground on their own. Often, these same individuals have balance and stability issues which can cause repeated falling. Falls often occur in or about the home and most result in very minor or no injury to the fallen person or patient. It is not unusual for the patient to be attended by a single typical caregiver, as in the case of an elderly couple. Most often, a single typical caregiver is not capable of lifting the fallen person, and is at great risk of serious personal injury if a lift is attempted.

A very common solution is to summon emergency personnel for a lift assist, often followed by an unnecessary and costly trip to the hospital for assessment. The hospital visit also needlessly exposes the likely immuno-compromised patient to potential contagious diseases and unnecessary medical procedures. By summoning emergency personnel for a lift assist, the EMTs, paramedics or firefighters are occupied lifting a patient when a genuine life-threatening emergency may arise elsewhere. In addition, the patient and caregiver are subjected to the embarrassment of the fire trucks or ambulance in the driveway and the ensuing commotion.

A device is needed which is suitable for a single typical caregiver to lift a patient from the floor or ground without causing discomfort to the patient, or injury to the caregiver. The device should be easily collapsible, conveniently transportable, compactly storable, and readily opened for service and use by a single typical home caregiver.

The lifting device and system departs drastically from the conventional concepts and designs of prior art through the novel application of pivoting, hinged, and sliding connections, hinged braces, and other aspects.

DISCUSSION OF THE PRIOR ART

As a preliminary note, it should be stated that there is an ample amount of prior art dealing with lifting systems. However, when related to lifting a person who is incapable of getting up from the floor or ground, the prior art shows multiple deficiencies and defects, particularly for a single typical caregiver.

A. The Wingire Patent (U.S. Pat. No. 1,214,104) discloses a simple non-braced tripod, with a winch. The device lacks the capability of lifting and positioning a person in a sitting position, or in a wheelchair. The three-legged configuration inhibits seating and wheelchair access. There is no provision for a seat member. The narrowing of the legs at the top creates a space which is insufficient for the upper body of a person. It has no stabilizing braces for support or assistive grab bars.

B. The Flachs Patent (U.S. Pat. No. 4,860,404) is again a three-legged device, with the same limitations as the Wingire Patent. Additionally, the Flachs requires multiple component assembly and disassembly, beyond the capabilities of the typical caregiver.

C. The Woolley Patent (U.S. Pat. No. 3,765,630), again is a three-legged device, with the same disadvantages as the Wingire device, and the Flachs device.

D. The Hildemann Patent (U.S. Pat. No. 3,222,029) has become the standard of the institutional healthcare industry, used in hospitals and nursing homes routinely for patient transfer from chair to bed. However, it is not readily collapsible, not easily transportable, nor conveniently storable, making it less suitable for home use by a caregiver. Because of the design and lifting mechanism, it is not typically used to lift a patient from the floor. The hydraulic mechanism of the design has proven over time to be subject to repeated failure.

E. The Toothman Patent (U.S. Pat. No. 8,286,281 B1) involves telescoping legs, complex integral locking connections at the top support, a lack of stabilizing braces, and requires a complex erection process. There is no provision for a seat member, and no stabilizing braces. The hoist assembly as designed is on the inside of the frame which adds excessive height to an already cumbersome structure, and therefore is not suitable for home use by a typical caregiver.

F. The Bjork Application (U. S. Pat. Appl. 20070246974A1) discloses a device which requires complex assembly and disassembly, with a tent pole in socket type erection method. The unit consists of numerous pieces and parts. It incorporates an overhead motor device, necessitating lifting difficulty and complexity. There are no stabilizing braces for required support. The design requires additional forward leg extensions to prevent overturn of the device. This device requires a complex erection methodology, along with additional appurtenances to offset defects of stability, making it well beyond the abilities of a single typical caregiver.

G. The Clark Patent (U.S. Pat. No. 9,814,644B) discloses a lifting device of a tri-fold method of collapse, with three fixed sides folding one on another. The heavy motive device required must be lifted overhead above the frame for mounting. Once erected, it is not easily mobile within a home. The design is directed toward EMS personnel, and wholly inappropriate for home caregiver utilization. While likely transportable by a fit emergency technician, it is not easily transportable by a single typical caregiver. The erection of the device is beyond the capabilities of the typical home caregiver. The device is not suitable for disassembly by a typical home caregiver.

H. The Stevenson Patent (U.S. Pat. No. 1,962,042) discloses a lifting device for elevating a person above a bed. The device may only be folded in half, and remains wider than a bed. It is not readily transportable or storable in a confined space.

BRIEF DESCRIPTION OF THE DRAWINGS

FIG. 8 is a view of the lifting device with a seat member, and the under view of the seat member

DETAILED DESCRIPTION OF THE INVENTION

Figure 1:
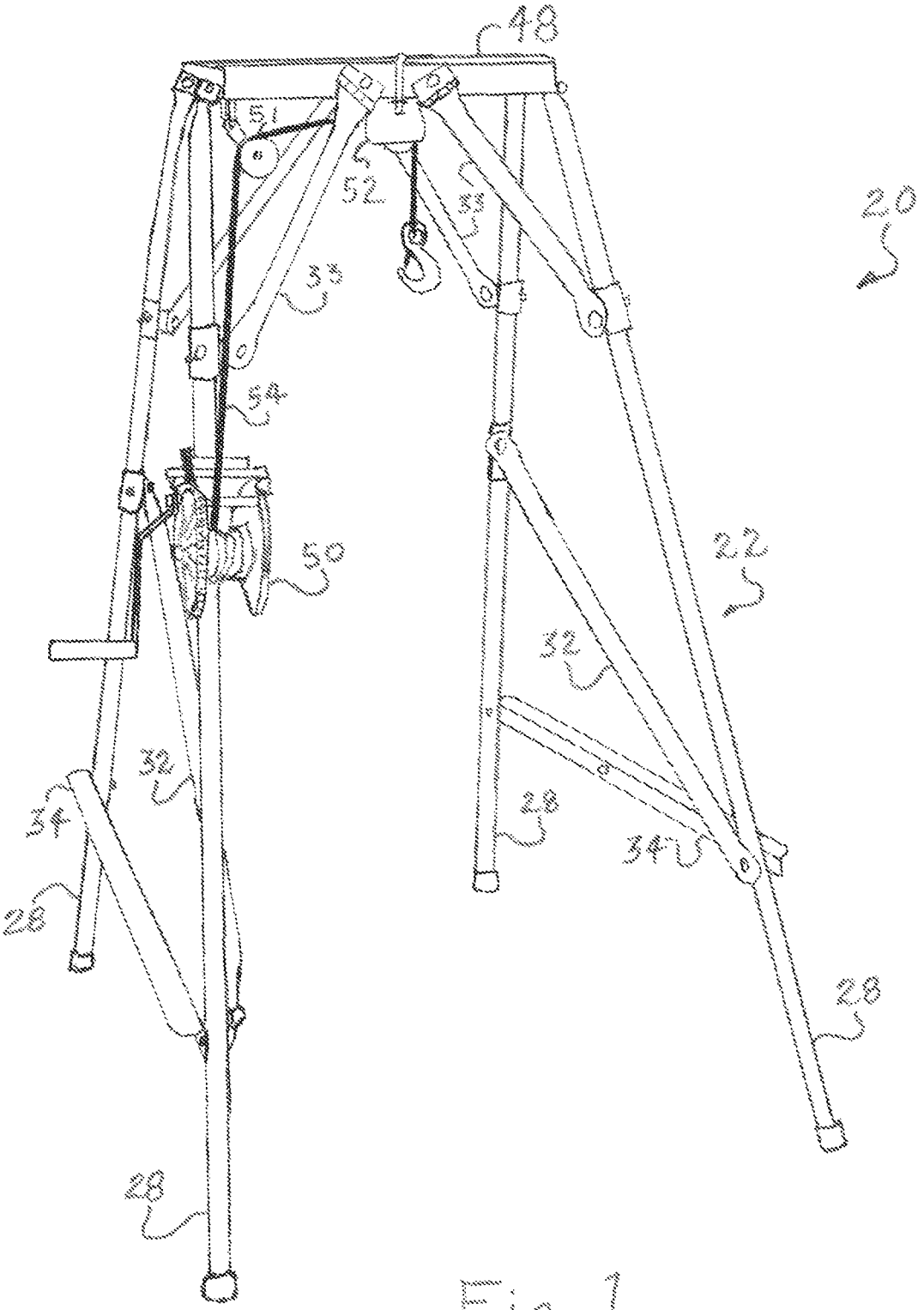
FIG. 1 is a perspective view of an embodiment of the lifting device.

The embodiments herein described are of the collapsible lifting device which is suitable for lifting a person from the floor without causing discomfort, while being easily collapsible, conveniently transportable, readily opened for service, compactly storable, and fully usable by a single typical home caretaker. The embodiments of the lifting device and system depart drastically from the conventional concepts and designs of prior art through the novel application of pivoting, hinged, and sliding connections, hinged braces, and other aspects.

An embodiment of the lifting device will now be described more fully hereinafter with reference to the accompanying drawings, in which a few different embodiments are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize the following descriptions of the embodiments of the lifting device are only illustrative and not intended to be limiting in any way. Other embodiments of the lifting device will readily suggest themselves to such skilled persons having the benefit of this disclosure. Like numbers refer to like elements throughout.

Although the following detailed description contains many specifics for the purpose of illustration, anyone of ordinary skill in the art will appreciate that many variations and alterations to the following details are within the scope of the invention. Accordingly, the following embodiments of the lifting device are set forth without any loss of generality to, and without imposing limitations upon, the claimed invention.

In this detailed description of embodiments of the lifting device, a person skilled in the art should note that directional terms, such as "above", "below", "upper", "lower", and other like terms are used for the convenience of the reader in reference to the drawings. Also, a person skilled in the art should notice this description may contain other terminology to convey position, orientation, and direction without departing from the principles of the embodiments of the lifting device.

Furthermore, in this detailed description, a person skilled in the art should note that quantitative qualifying terms such as "generally", "substantially", "mostly", and other terms are used, in general, to mean that the referred to object, characteristic, or quality constitutes a majority of the subject of the reference. The meaning of these terms is dependent upon the context within which it is used, and the meaning may be expressly modified.

In this disclosure, many terms may be interchangeably used and should be understood by those skilled in the art not to be limiting in any way. For example, a "patient", a "user", or a "person" may be used to describe an individual that is being lifted using the lifting device according to embodiments of the lifting device.

An embodiment of the lifting device, as shown and described the various figures and accompanying text, provides a lifting device 20. The lifting device 20, according to embodiments of the lifting device, may advantageously be used to assist in lifting a person or a patient from the ground. For example, the lifting device 20 may be used by ambulance personnel, or an in-home caretaker, to lift a patient that may have fallen. Also, for example, the lifting device 20 may be used by hospital personnel to lift patients, or to assist patients that are not otherwise mobile, who may need to be moved from one position to another, e.g. from a wheelchair to a cot. Those skilled in the art will appreciate that the lifting device 20, according to embodiments of the lifting device, may advantageously be used for any number of lifting necessities in any number of different situations.

The lifting device 20, may be used to prevent back injury, for example, of personnel that make be responsible for lifting patients, being rescue workers, or caregivers. Back injuries may occur to ambulance personnel or home caregivers when attempting to lift such patients, especially when the person is located on the floor or ground. Using the lifting device 20, according to the embodiments of the lifting device, may advantageously reduce, or even eliminate such back injuries.

Further, the use of the lifting device 20, may greatly reduce the injury to the patient. The process of lifting a patient from the floor or ground can sometimes be dangerous. The lifting device 20, may advantageously be used to readily lift the patient as necessary, while simultaneously reducing the risk to patient and caregiver.

Figure 14:
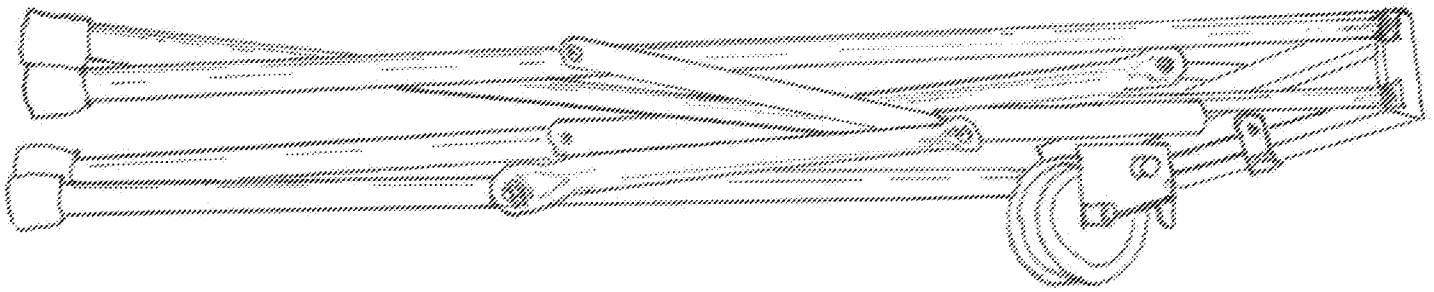
FIG. 14 is another view of the lifting device in a collapsed position

Referring now more to FIG. 1, additional features of the lifting device 20 are now described in greater detail. More specifically, the lifting device 20 may illustratively include a main body member 22. The main body member 22 may be collapsible so as to minimize space necessary for storage and to allow a user to be able to readily transport the lifting device 20. The main body member 22 of the lifting device 20, is shown in the collapsed position in FIG. 5 and FIG. 14. Additional details of the collapsibility of the main body member 22 of the lifting device 20 will be discussed in greater detail below.

The lifting device 20 may also illustratively include a seat member 24 that is adapted to engage a portion of the main body member 22 when the main body member is in the opened position. The seat member is also illustrated in FIG. 8, and will be discussed in greater detail below.

As briefly noted above, the main body member 22 of the lifting device 20 may be moved between a collapsed position and an opened position. The lifting device 20 is illustrated in the open position in FIG. 1, and in the collapsed position in FIG. 5. The collapsed position may allow for a user to readily transport the lifting device 20, and to allow for easy and convenient storage of the lifting device 20.

Figure 3:
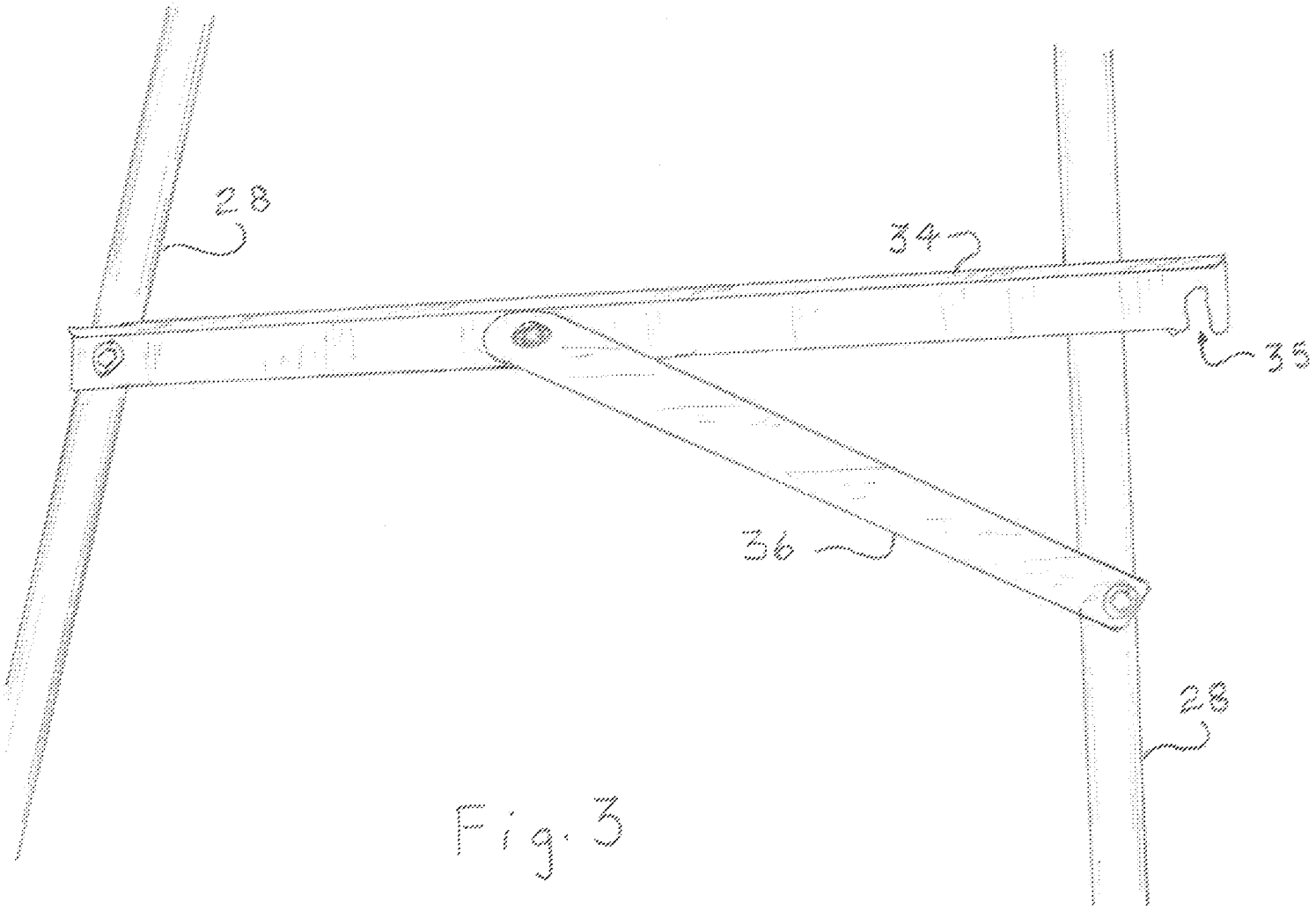
FIG. 3 is a view of the horizontal hinged brace

The lifting device 20 may include a pair of side support members, or legs 28. The side support members 28 may be connected to one another by a pivotally connected hinged brace 34, more fully detailed in FIG. 3, shown in the partially collapsed position. In this illustrated embodiment of the lifting device 20, the brace 34 may be pivotal on one end, pivotal in the center, and notched on the other end. The connecting bar 36 may be pivotal on both ends, with one end pivotally connected to the center of the brace 34 and the other end of the connecting bar 36 may be pivotally connected to a side support member 28, providing for a collapsible method when rotated upward, yet securely positioned in the notch when in the opened position. When the lifting device 20 is in the open position, the braces 34 may be used as support for a seat member 24.

Figure 4:
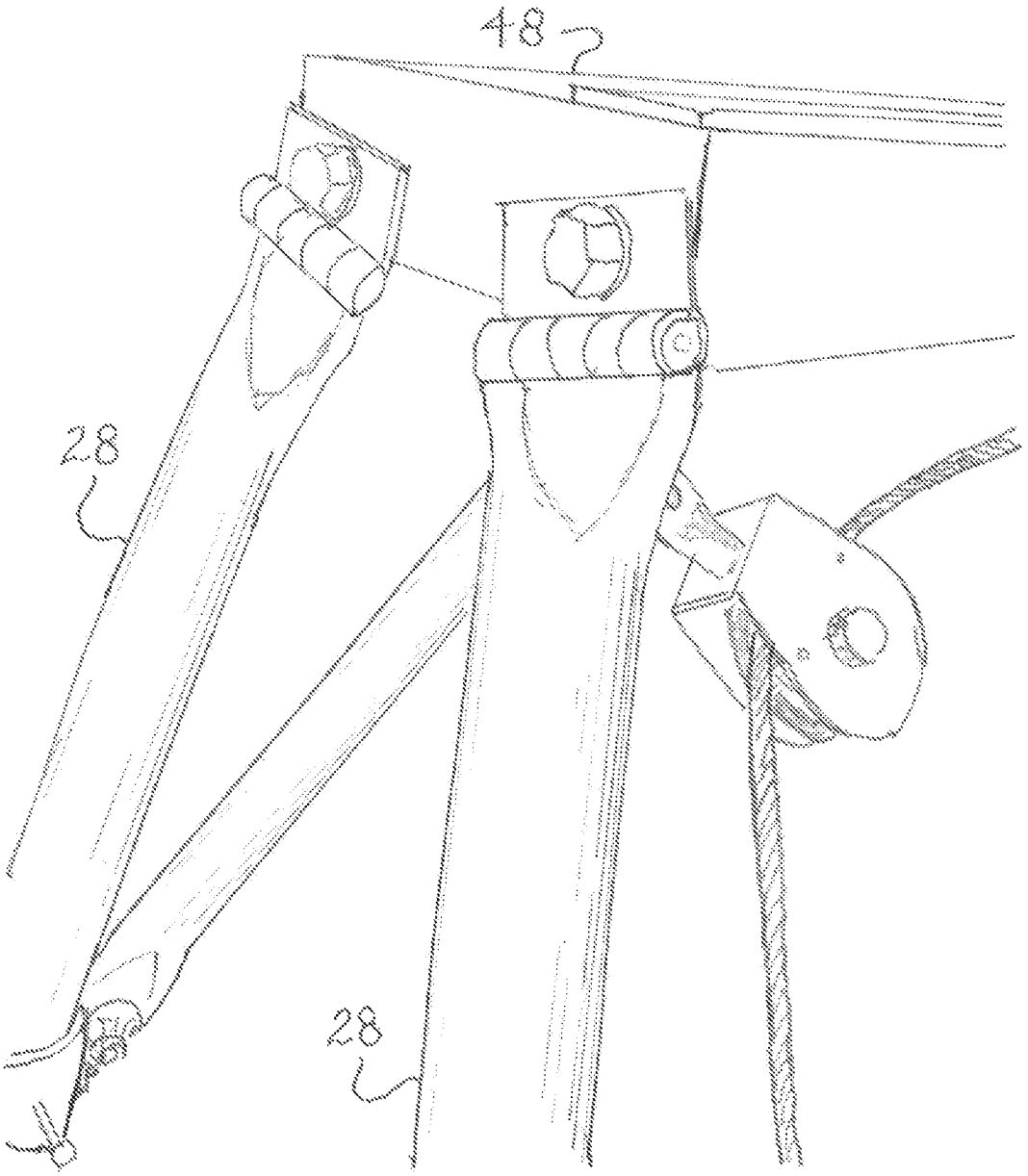
FIG. 4 is a view of the pivotally mounted hinged connection of the legs to the top support member

The side support members 28 may further be pivotally and hingedly connected to a top support member 48 as in this illustrated embodiment, as shown in FIG. 4, allowing for rotation of the legs 28 and the movement to the collapsed position.

Figure 6:
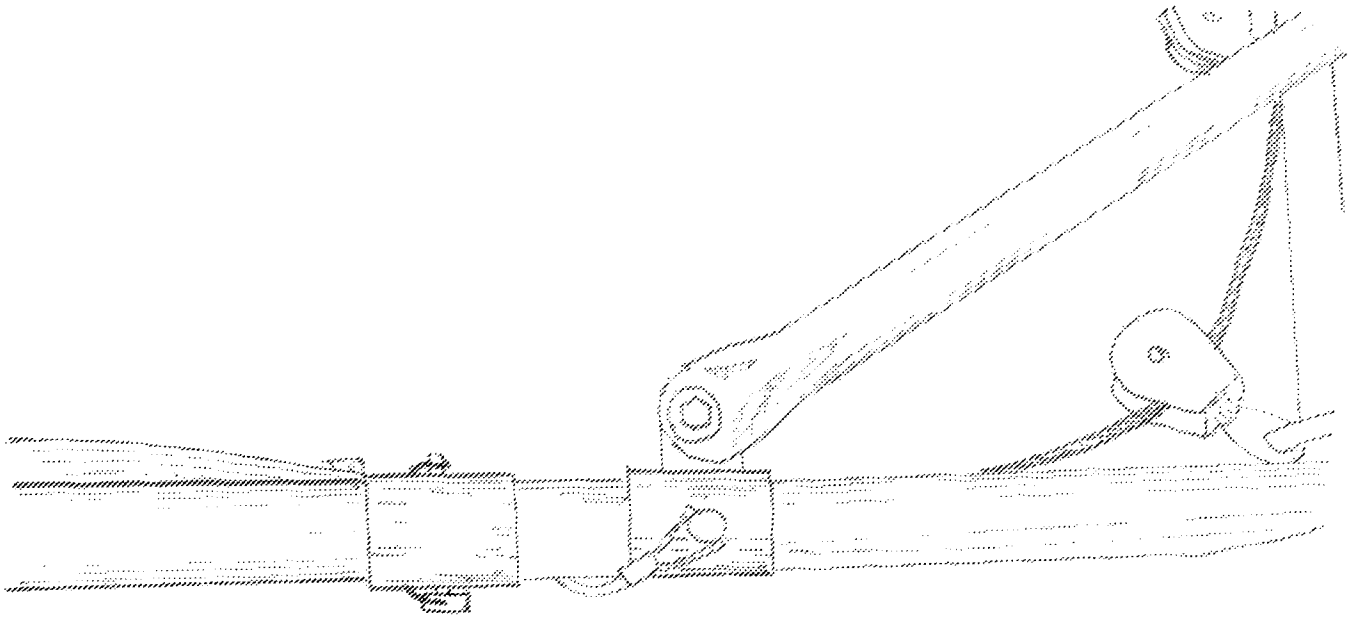
FIG. 6 is a view of a typical pivoting and sliding connection with locking pin

As shown in FIG. 1, each pair of side support members 28 may also be connected to one another with a middle brace 32 pivotally connected on one end to one leg 28 and pivotally and slidably connected on the other end to the opposing side support leg 28, the slidable connection being positionally fixable. When the lifting device 20 is in the open position, the middle braces 32 may be used as grab bars to help a lifted person rise to a standing position. In the present illustrated embodiment, FIG. 6 illustrates one of many possible configurations, in this example shown fixed with a locking pin. Those skilled in the art, however, will appreciate that any number of locking methods may be provided while still accomplishing the goals, features, and objectives according to the embodiments of the lifting device.

Figure 7:
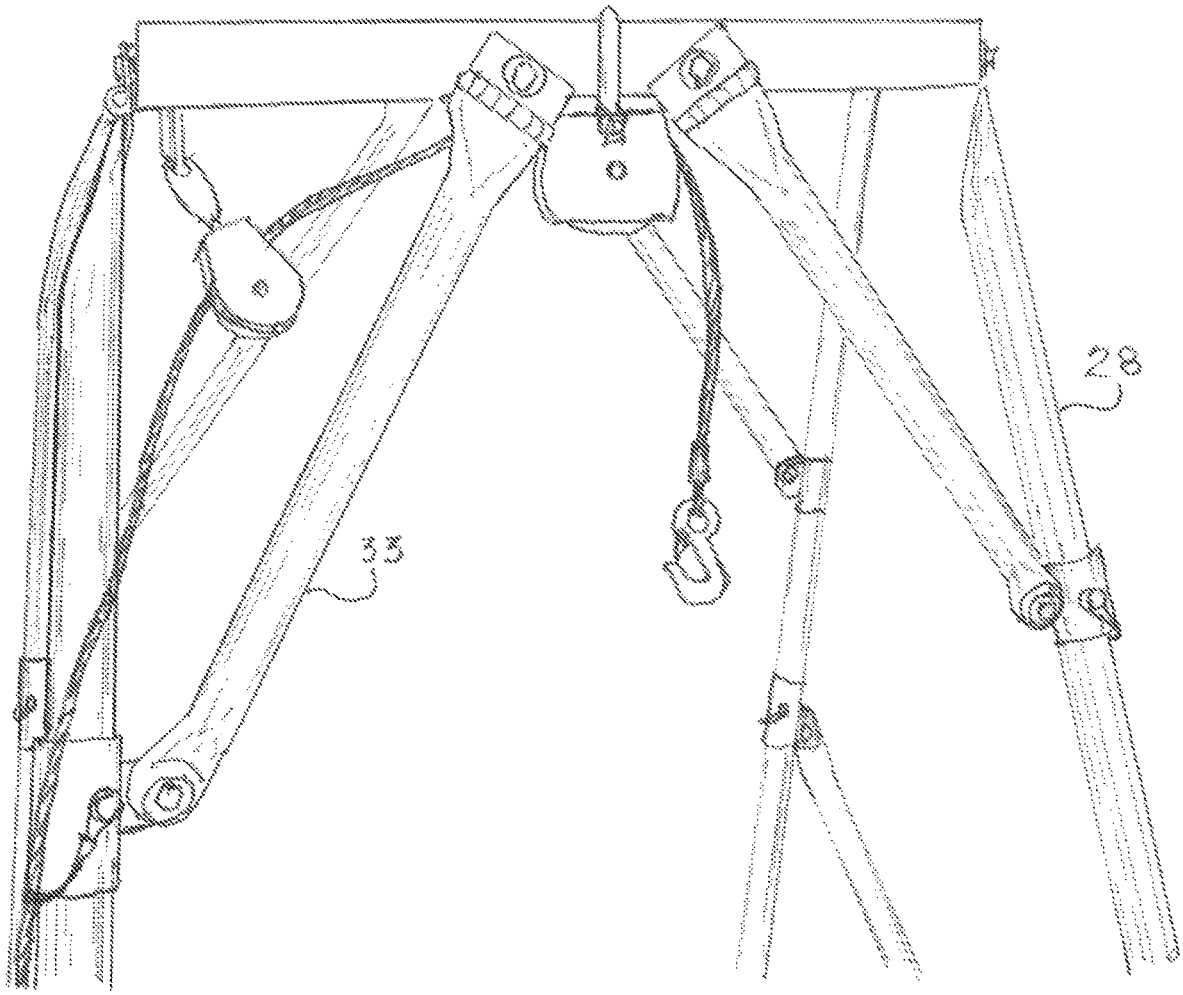
FIG. 7 is a view of the top support with side leg braces and pulleys

Each side support member or leg 28 may be connected with a brace 33 pivotally and hingedly connected at the top support member 48 and pivotally and slidably connected to the leg 28, said slidable connections being positionally fixable, which is the present embodiment illustrated in FIG. 7.

Referring now to FIG. 8, additional details of the seat member 24 are now described in greater detail. When the lifting device 20 is in the open position, the seat member may rest on the horizontal braces 34, and may be adjusted forward or rearward as needed. In the illustrated embodiment, handles are attached to the underside of the seat member 24 to prevent undesired lateral motion.

Figure 9:
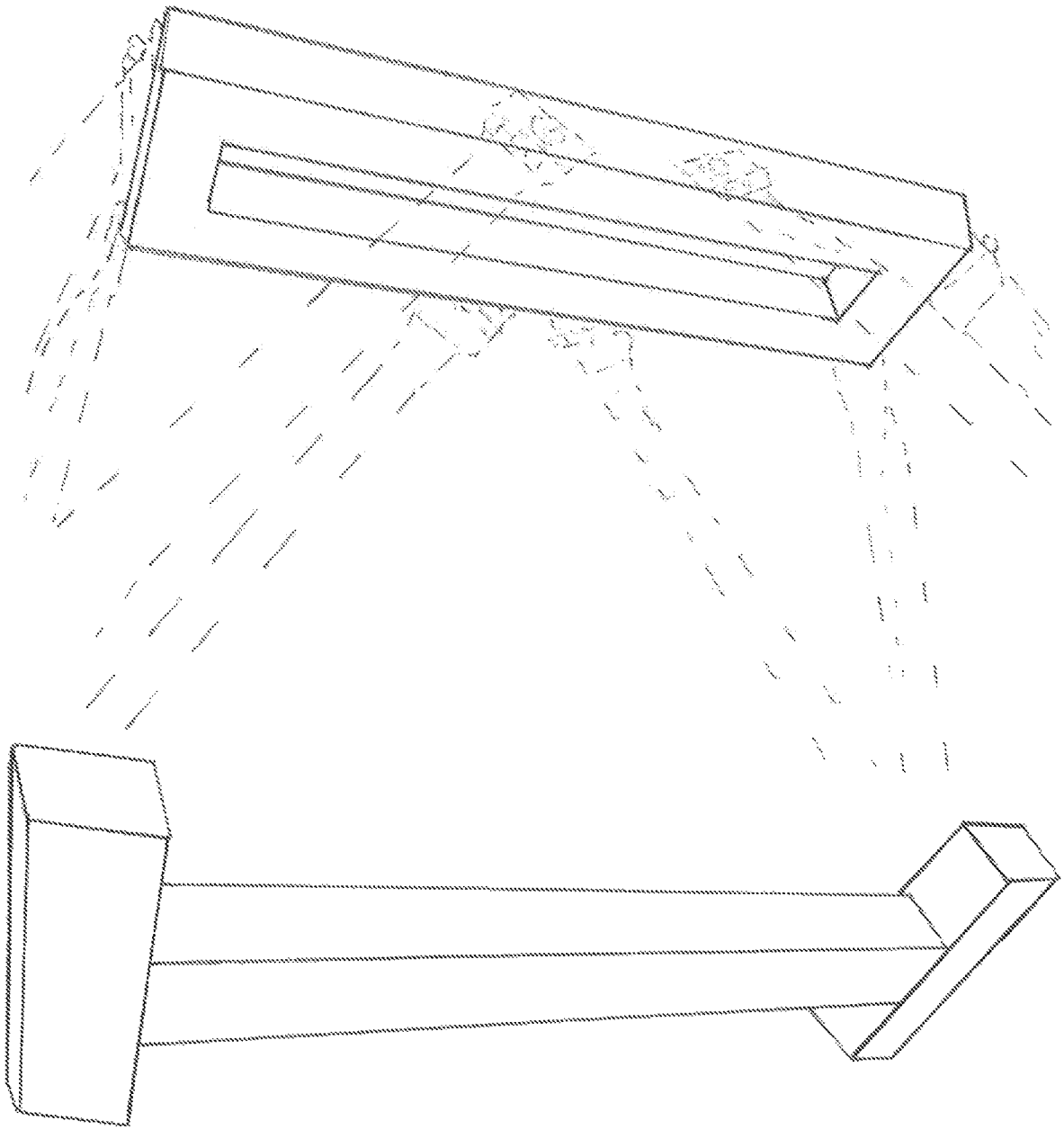
FIG. 9 is a view of the top support member, and an alternate configuration
Figure 10:
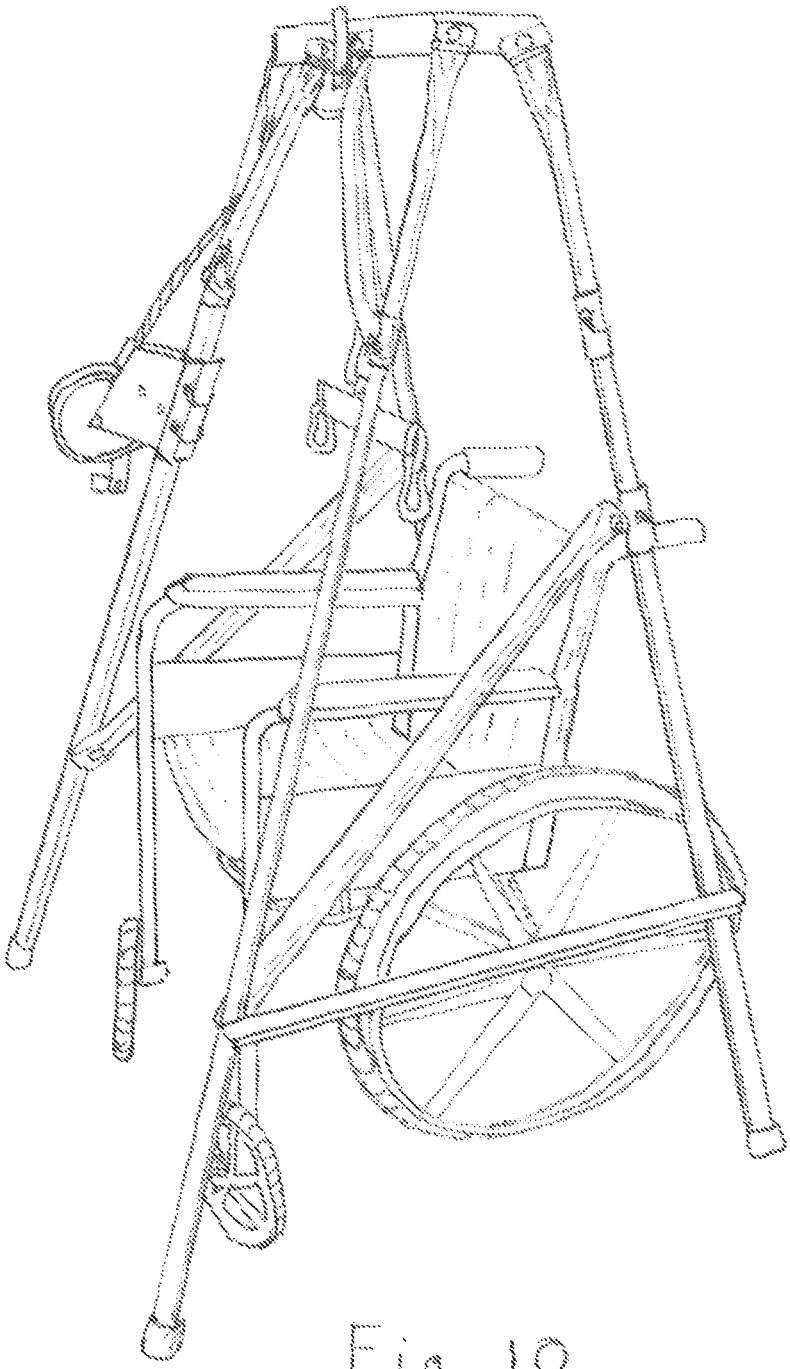
FIG. 10 is a view of the lifting device with a wheelchair positioned to receive a lifted patient

Referring now back to FIG. 1 and FIG. 9, the top member 48 of the lifting device 20 is now described in greater detail. The top member 48 may have a substantially polygonal shape. The top member 48 may have any shape while still accomplishing the goals, features and objectives according to the embodiments of the lifting device. FIG. 9 illustrates another embodiment of many possible shapes of the top support member 48.

Referring again to FIG. 1, the present embodiment of the lifting device 22 is illustrated with a hand winch 50 attached to one of the fore legs 28 at a convenient height, and the cable 54 is routed through a pulley 51 at the upper corner attached to the top member 48, and then through another attached pulley 52 at the center. Those skilled in the art will appreciate, however, that many possible hoist assembly types are readily adaptable, and numerous configurations are possible to achieve the goals, features, and objectives according to embodiments of the lifting device.

Figure 2:
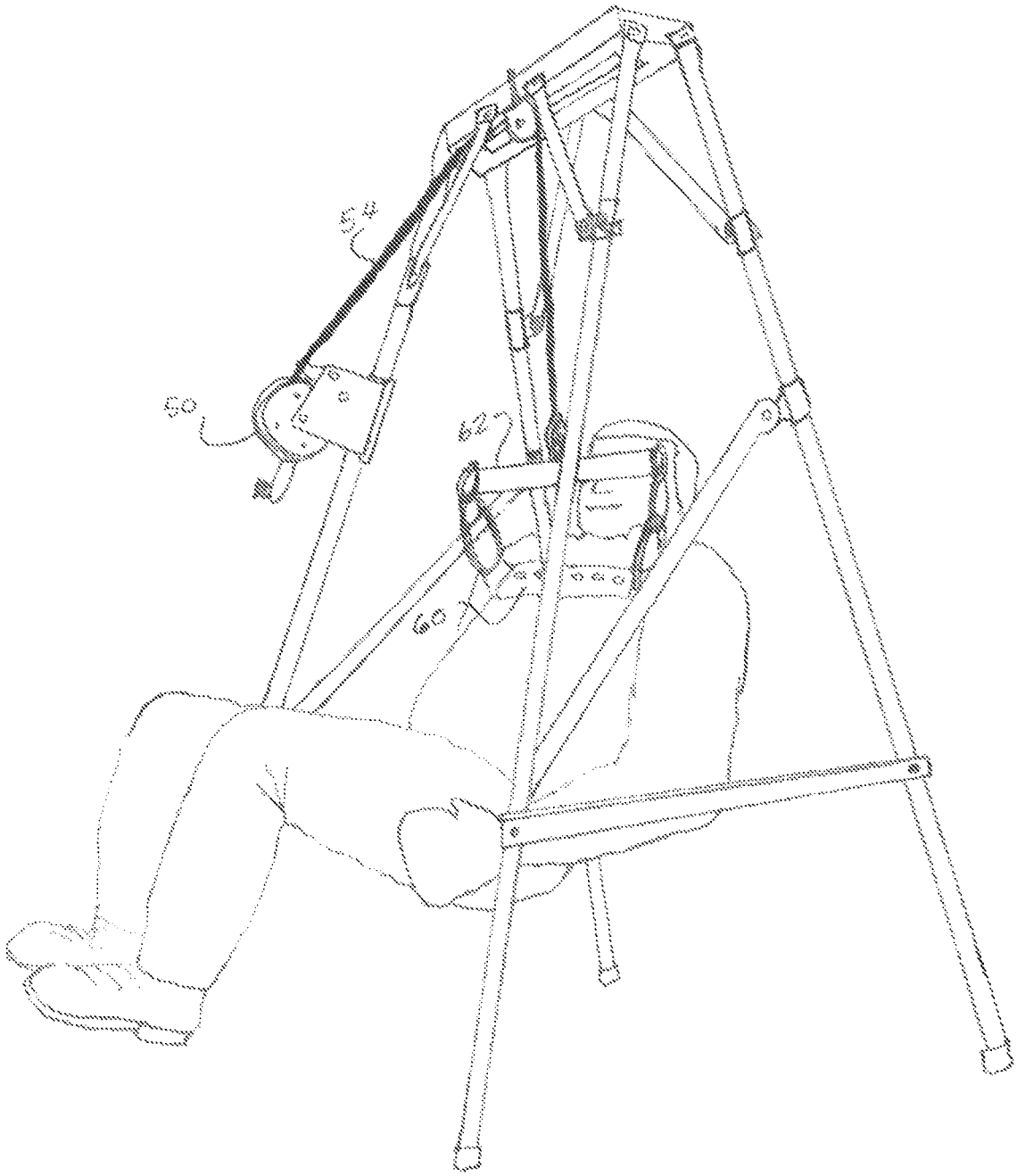
FIG. 2 is a view with a patient being lifted

Referring now back to FIG. 2, operation of the lifting device 20, according to an embodiment of the lifting device, is now described in greater detail. If, for example, a patient is on the floor or ground and needs to be lifted therefrom, the lifting device 20 may be used to achieve such a task. More specifically, an engagement strap 60 may be positioned around the patient, or person that needs to be lifted from the ground. Upon connecting the engagement strap 60 to the patient, the engagement strap 60 may be connected to the hoist assembly 50. As illustrated in FIG. 2, the engagement strap 60 is connected via a spreader bar 62 which serves to prevent crushing stresses on the patient. More particularly, the hoist assembly 50 may include a cable or line 54 that may connect to a portion of the hoist assembly and a portion of the spreader bar 62 and/or the engagements strap 60 so that the patient may be lifted when the hoist assembly 50 is engaged. The engagement strap 60 may, for example, be provided by a belt, sling, or any other type of device suitable for being positioned around a patient to assist in lifting the patient using the lifting device 20. More specifically, the engagement strap 60 may be positioned under the patient's arms, along with the use of a spreader bar 62 so the patient may be comfortably lifted. Those skilled in the art, however, will appreciate that a patient sling, a harness, or similar engagement apparatus may also be used to lift the patient utilizing the concepts revealed herein.

Figure 5:
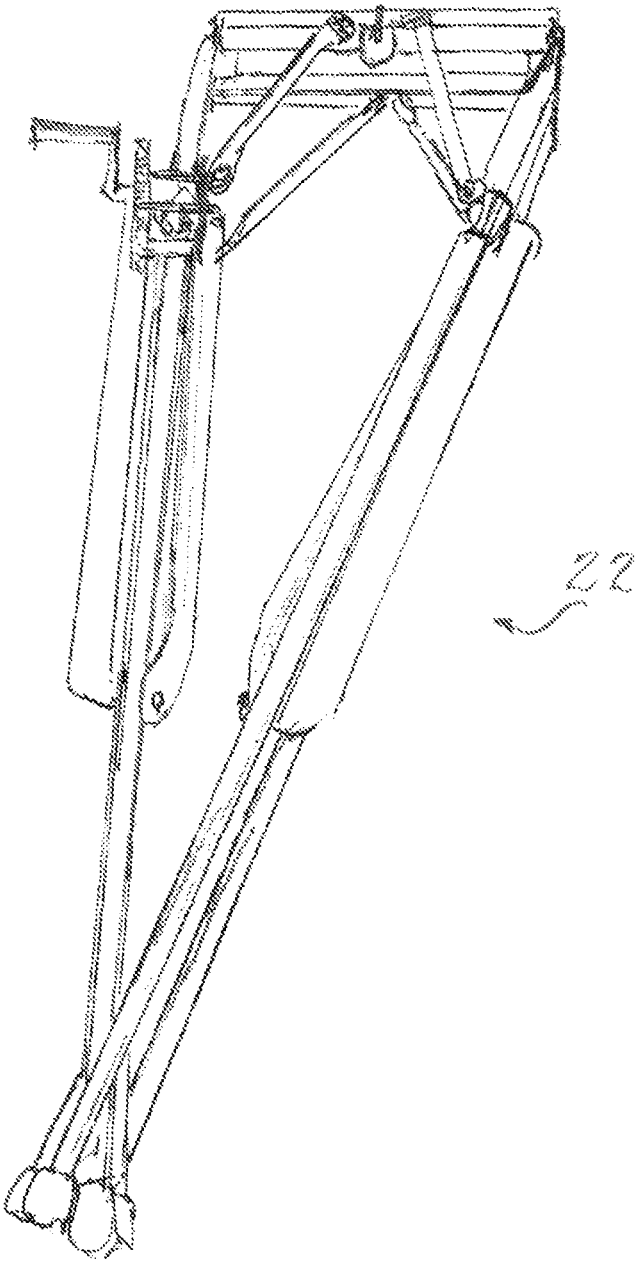
FIG. 5 is a view of the lifting device in the collapsed position

The lifting device 20, according to the embodiments of the lifting device, is advantageously configured for fast and easy set up. As illustrated in FIG. 5, when in the collapsed position, the lifting device 20 is compact, and does not use excessive space for storage or transport. Upon removal from storage, the lifting device 20 may be easily transported to the desired location and set up for use. A typical set up method may be as follows: spread the feet apart, insert locking pins in positions for braces 33. Stand the lifting device 20 up and spread the feet while lowering braces 34 engaging the slots 35. Insert locking pins into position for braces 32. The lifting device 20 is now ready for operation, quickly and simply. Collapsing of the lifting device 20 may be accomplished in the reverse order.

Once a patient is lifted from the ground to a sufficient height, the seat member 24 or a wheelchair may be positioned under the patient and the patient may be lowered onto the seat. It should be noted that the illustrated embodiment of the lifting device also provides multiple opportunities for the patient to utilize various braces and supports as grab bars for additional stability or to assist in the standing process if desired.

Figure 11:
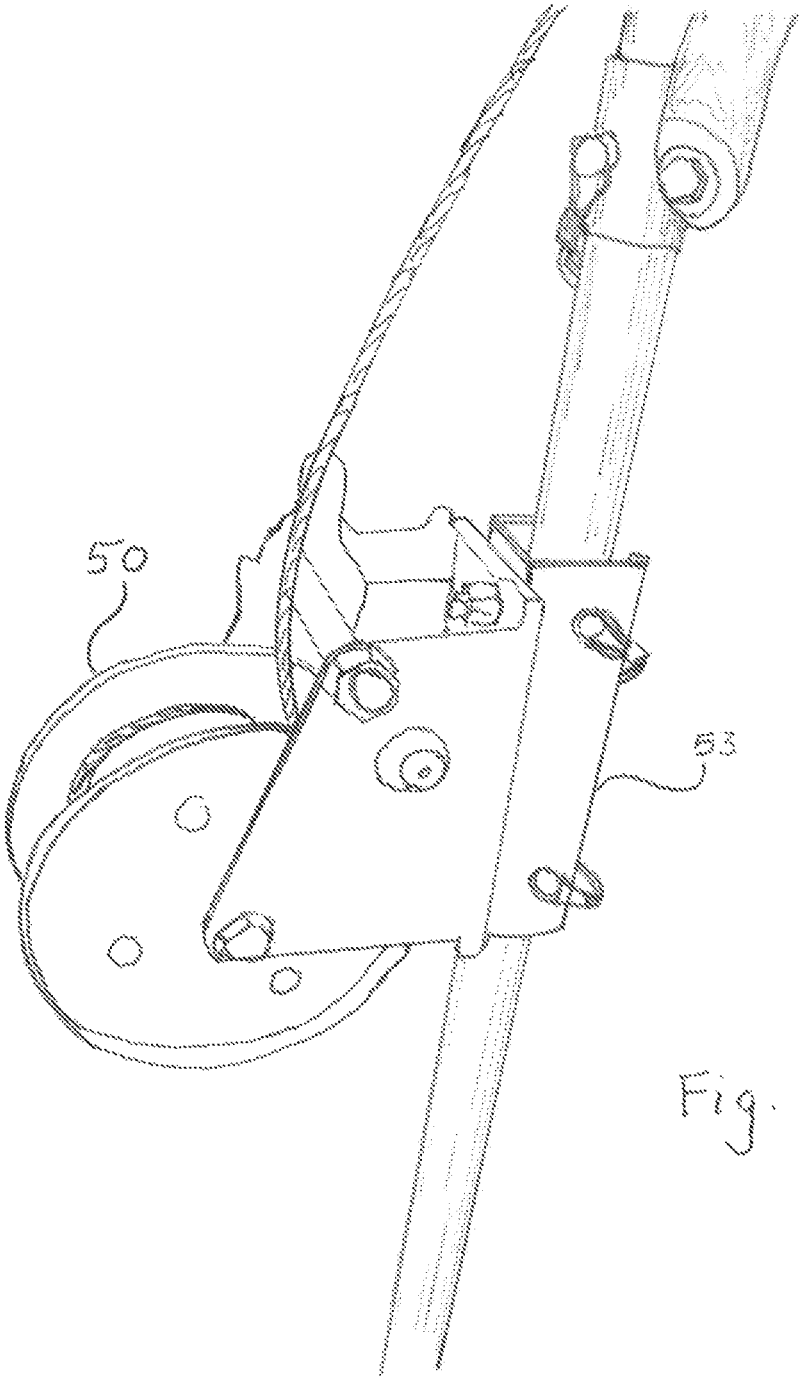
FIG. 11 is a view of a winch on a pivoting and positionally fixable mount
Figure 12:
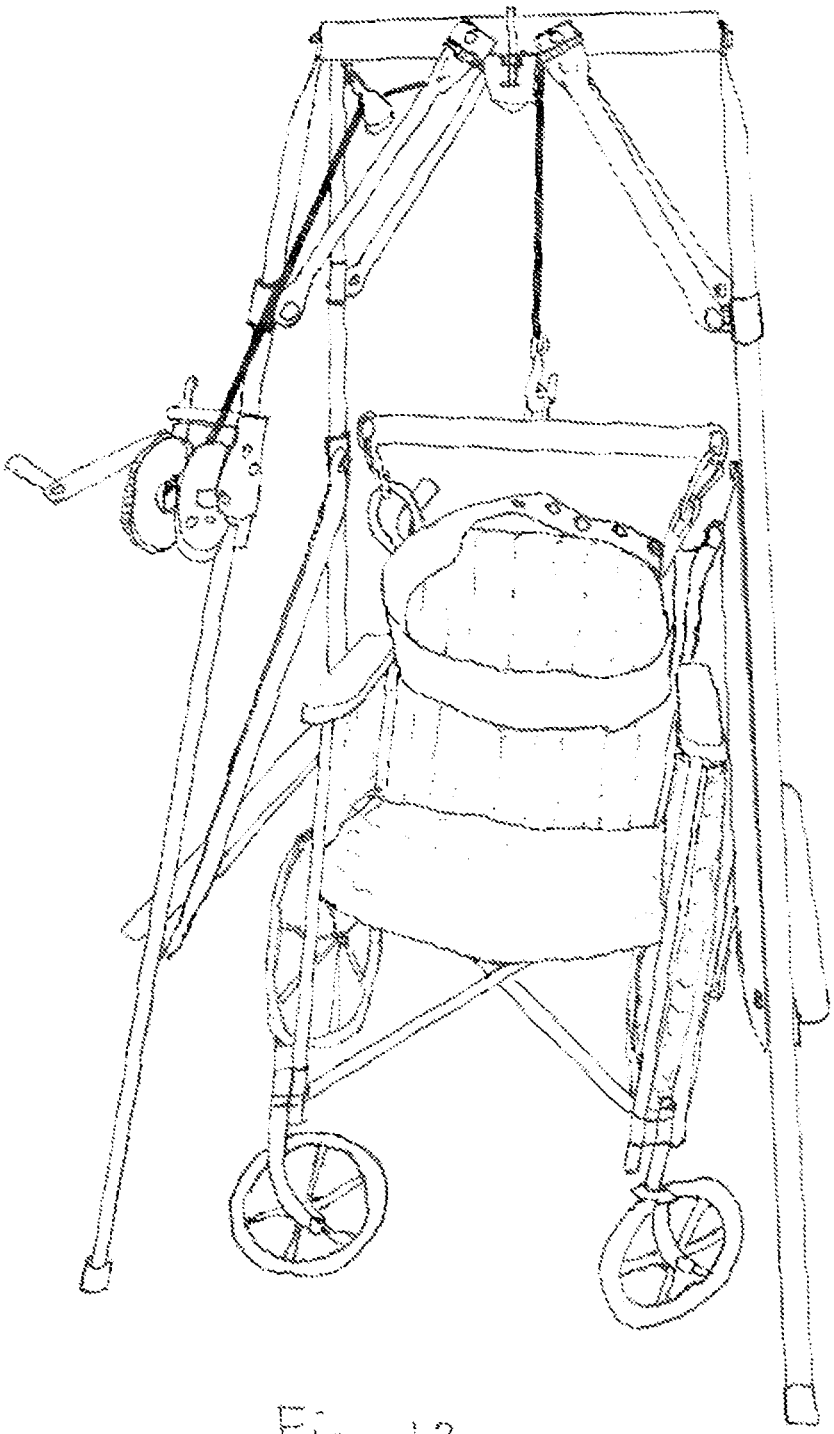
FIG. 12 is a front view of the lifting device with a wheelchair, a spreader bar, and a connected lifting strap

Referring now to FIG. 11, in the present illustrated embodiment of the lifting device 20, it may be noted that the winch portion of the hoist assembly 50 is secured to a mount 53 which is rotatable and positionally fixable, enabling the winch 50 to be rotated to the center between the legs 28. When the lifting device 20 is in the collapsed position, such a rotated position increases the collapsibility and compactness of the device further for shipping, transport, or storage.

Figure 13:
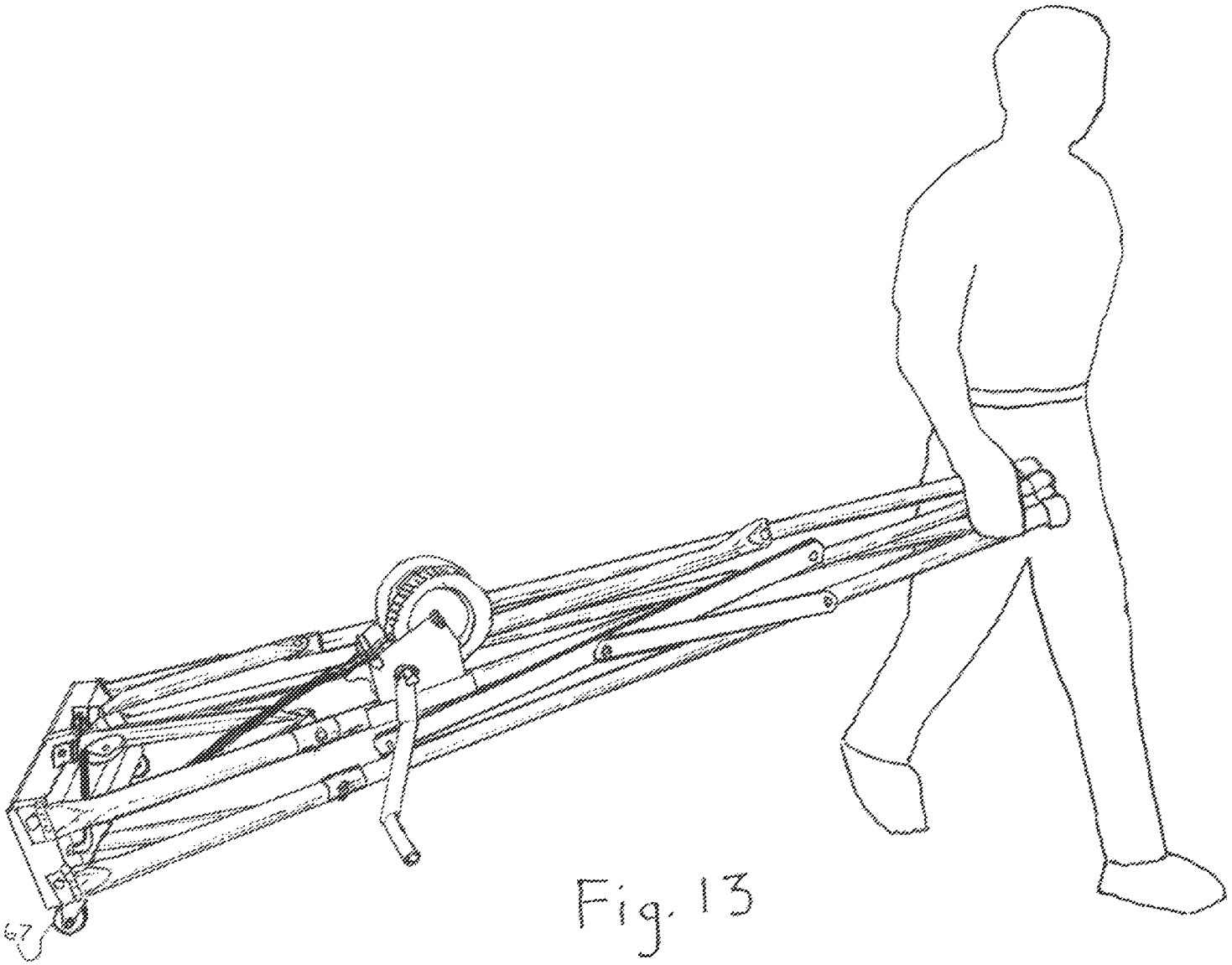
FIG. 13 is a view of a person pulling the lifting device utilizing casters

The lifting device 20 may be easily carried by one person, however, an alternate method of transport is shown in FIG. 13. In the present illustrated embodiment of the lifting device 20, it may be noted that there are two casters, or wheels 67 attached to the top support 48 which may assist in the transport by a person simply pulling the lifting device 20 by the legs 28 when in the collapsed position. Those skilled in the art, however, will appreciate that there are many other wheel configurations to achieve the same goals, features, and objectives according to the embodiments of the lifting device.

The components of the lifting device 20 may be made from many different materials including, but not limited to steel, aluminum, graphite, carbon fiber, wood, and the like. Those skilled in the art will appreciate that the components of the lifting device 20 may be made of any number of materials while still achieving the goals, features, and objectives according to the embodiments of the lifting device.

For the purpose of height adjustment, the legs 28 may also be extendable by any number of means or methods such as telescoping tube or otherwise as would be appreciated by those skilled in the art.

Although the description above contains many specificities, these should not be construed as limiting the scope of the embodiments but as merely providing illustrations of several embodiments. For example, the top support 48 can have many shapes, the legs 28 may be made extendable or adjustable, the braces 33 and 34 may be in a different configuration, different styles of hinges could be used, other locking methods may be used for positional fixing of slidable connections, different types of slidable connections may be used, etc.

Thus the scope of the embodiments should be determined by the appended claims and their legal equivalents, rather than by the examples given.

That which is claimed:

1. A collapsible lifting device comprising:

a. a top member having a center length, multiple opposing sides, a front side, a rear side, a left end and a right end;

b. four tubular legs wherein each leg consists of a top end, a length configured to accommodate a lifted person, and a bottom end;

wherein the top end of each said leg is pivotally and hingedly connected to said top member;

wherein two of said legs are connected to the said left end of said top member and the other two said legs are connected to the said right end of said top member;

wherein said legs on each end comprise a side pair of one front leg and one rear leg;

c. a horizontal center hinged brace pivotally connected to each said rear leg and notch connected to each said front leg per said side pair of legs;

wherein said center hinged brace is connected at a height configured to accommodate a seat member for a sitting person;

d. a middle diagonal brace pivotally connected to each said rear leg and pivotally and slidably connected to each said front leg per said side pair of legs;

e. an upper diagonal brace for each said leg pivotally and hingedly connected to said top member with each said upper diagonal brace extending downward and pivotally and slidably connected to each of the said legs;

wherein two said upper diagonal braces are pivotally and hingedly connected to the said front side of said top member and diagonally extend downward and being pivotally and slidably connected to the two said front legs;

wherein two said upper diagonal braces are pivotally and hingedly connected to the said rear side of said top member and diagonally extending downward and being pivotally and slidably connected to the two said rear legs;

f. a connected hoist assembly mounted on one of said legs at a height configured for a person to operate;

wherein a hoist line routes from said hoist assembly through two pulleys mounted to said top member;

wherein said hoist line is connected to a spreader bar;

wherein said spreader bar is connected to a means of engagement for lifting a person;

g. wherein all slidable connections are positionally fixable;

h. wherein said lifting device is movable between a collapsed position and an open position;

i. wherein said collapsed position is defined as said bottom ends of said legs being together;

j. wherein said open position is defined as the said bottom ends of said legs being separated apart with said slidable connections positionally fixed and with said notch connections engaged, and all said slidable connections are positionally fixed.

2. A method for lifting a person from the floor by a single caregiver comprising:

a. providing said lifting device of claim 1 and transporting said lifting device to the proximity of said person on the floor and opening said lifting device to said open position;

b. connecting said cable of said hoist assembly to said spreader bar;

c. connecting said spreader bar to said means of engagement for lifting a person;

d. utilizing said hoist assembly, lifting said person to a height suitable for seating;

whereby said person is easily lifted from the floor to a seated position and placed on a seat member without injury to said person or to said single caregiver;

whereby said person may utilize said middle diagonal braces as grab bars for support in rising to a standing position;

e. wherein said lifting device is transportable and moveable to said open position by said single caregiver;

f. wherein said lifting device is collapsible to said closed position and transportable by said single typical caregiver.

* * * * *